US006741826B2

(12) United States Patent
Park et al.

(10) Patent No.: US 6,741,826 B2
(45) Date of Patent: May 25, 2004

(54) CAM MOTION DESIGN WITHOUT DRIVETRAIN BACKLASH REVERSAL

(75) Inventors: Daniel C. Park, West Linn, OR (US); David W. Johnson, Tigard, OR (US)

(73) Assignee: Xerox Corporation, Stamford, CT (US)

( * ) Notice: Subject to any disclaimer, the term of this patent is extended or adjusted under 35 U.S.C. 154(b) by 39 days.

(21) Appl. No.: 10/184,448

(22) Filed: Jun. 26, 2002

(65) Prior Publication Data

US 2004/0001728 A1 Jan. 1, 2004

(51) Int. Cl.[7] ..... G03G 15/00; G03G 15/16

(52) U.S. Cl. ..... 399/313; 399/75; 399/167; 399/308

(58) Field of Search ..... 399/75, 107, 159, 399/164, 174, 223, 225, 226, 298, 299, 300, 302, 303, 308, 313, 317, 328, 329, 345, 66; 74/409, 440, 569, 567

(56) References Cited

U.S. PATENT DOCUMENTS

| | | | | | |
|---|---|---|---|---|---|
| 3,599,515 | A | | 8/1971 | Grabovac | 81/483 |
| 4,121,868 | A | | 10/1978 | Pierce et al. | 294/116 |
| 4,232,217 | A | | 11/1980 | Juziuk et al. | 235/480 |
| 4,431,126 | A | | 2/1984 | Jones | 226/121 |
| 4,431,301 | A | * | 2/1984 | Hashimoto et al. | 399/313 X |
| 4,723,184 | A | | 2/1988 | Takai et al. | 360/96.3 |
| 4,752,845 | A | | 6/1988 | Suzuki | 360/95 |
| 4,798,129 | A | | 1/1989 | Staub, Jr. | 92/128 |
| 4,977,765 | A | | 12/1990 | Legault et al. | 70/268 |
| 5,023,667 | A | * | 6/1991 | Negoro et al. | 399/317 |
| 5,532,795 | A | * | 7/1996 | Tatsumi et al. | 399/167 X |
| 5,689,764 | A | * | 11/1997 | Fukuchi et al. | 399/75 |
| 5,852,950 | A | | 12/1998 | Kurantani | 74/440 |
| 5,873,019 | A | * | 2/1999 | Mizuishi | 399/313 |
| 5,940,671 | A | * | 8/1999 | Kim | 399/308 X |
| 6,385,405 | B1 | * | 5/2002 | Kingsland | 399/226 X |

FOREIGN PATENT DOCUMENTS

| | | |
|---|---|---|
| EP | 0 528 863 B1 | 3/1993 |
| WO | W/O98/430302 | 9/1998 |

* cited by examiner

*Primary Examiner*—Sophia S. Chen

(57) ABSTRACT

A cam mechanism for a printer that includes a cam including an active cam surface having a continually increasing radius over an active cam angle, a biased cam follower in contact with the active cam surface, and a drive mechanism for rotating the cam such that only the active cam surface contacts the cam follower.

30 Claims, 3 Drawing Sheets

CAM MOTION DESIGN WITHOUT DRIVETRAIN BACKLASH REVERSAL

BACKGROUND OF THE DISCLOSURE

Printing apparatus can employ cam mechanisms to accomplish various functions. For example, in a printer that uses an intermediate transfer surface that is applied to a transfer drum, a cam mechanism can be employed to selectively bring a transfer surface applicator into contact with the transfer drum. The cam mechanism can be driven by a gear train, and backlash can be present in the gear train as a result of center-distance tolerances between gears and other components. Backlash reversals, which occur when a gear train reverses torque, can cause noise, and it can be difficult to avoid torque reversals.

An example of a printing apparatus that uses an intermediate transfer surface is a printer that applies a liquid intermediate transfer surface onto a substrate such as an imaging drum, deposits marking material such as ink on the intermediate transfer surface to form an image on the intermediate transfer surface, and then presses a print medium against the transfer surface to transfer the image to the print medium. The image forming marking material can be deposited by jetting ink such as melted solid ink. A cam mechanism can be employed to selectively engage a drum maintenance system with the imaging drum, for example as disclosed in commonly assigned U.S. Pat. No. 5,988,808, incorporated herein by reference.

DETAILED DESCRIPTION OF THE DISCLOSURE

Figure 1:
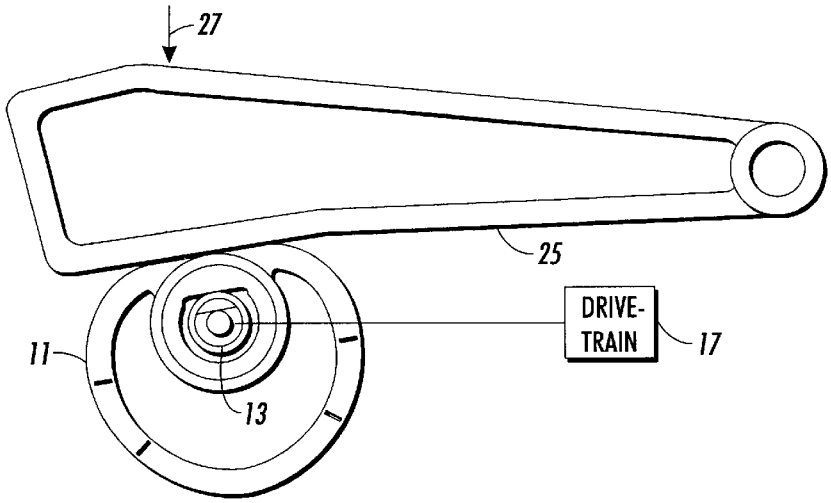
FIG. 1 is a schematic block diagram of an embodiment of a cam mechanism.
Figure 4:
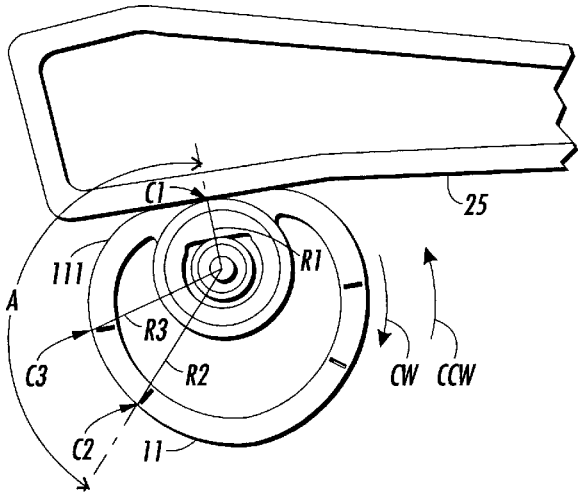
FIGS. 4, 5 and 6 are schematic elevational views of an embodiment of a cam that can be used in the cam mechanisms of FIGS. 1–3.
Figure 5:
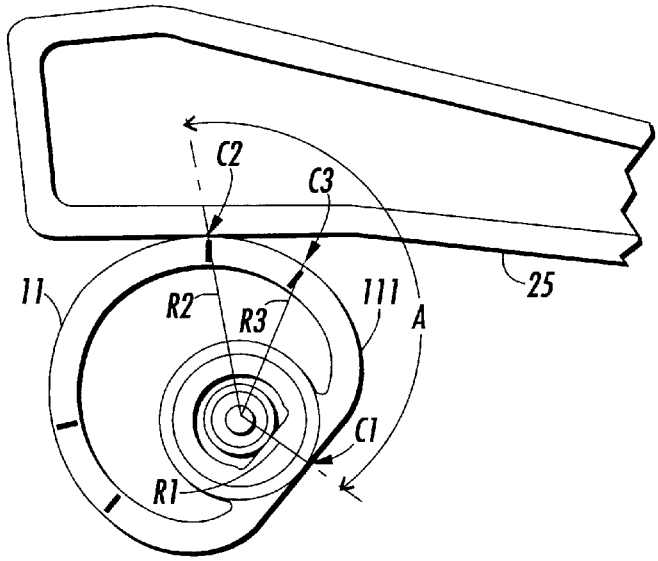
Figure 6:
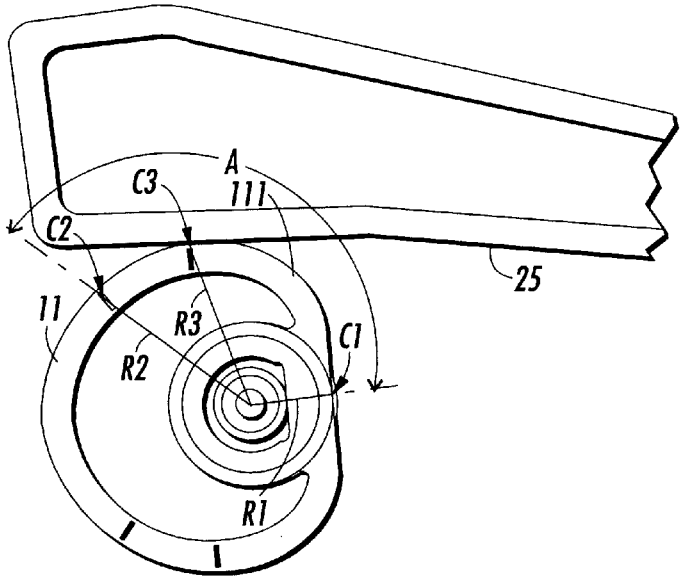

FIG. 1 is a schematic block diagram of an embodiment of a cam mechanism that includes a cam 11 mounted on a cam shaft 13 which is driven by a drive train 17 that can include gears. The cam 11 includes an active cam surface 111 (FIGS. 4, 5 and 6) that is contained within an active cam angle A (FIGS. 4, 5 and 6). A cam follower 25 is slidably engaged against the active cam surface 111, and is biased or loaded by a load force 27 to apply a cam follower force to the active cam surface 111. The load force 27 can be provided by a spring or by the weight of apparatus actuated by the cam follower 25. As described further herein, the profile of the active cam surface 111 is configured to avoid torque reversals in the gear train 17.

Figure 2:
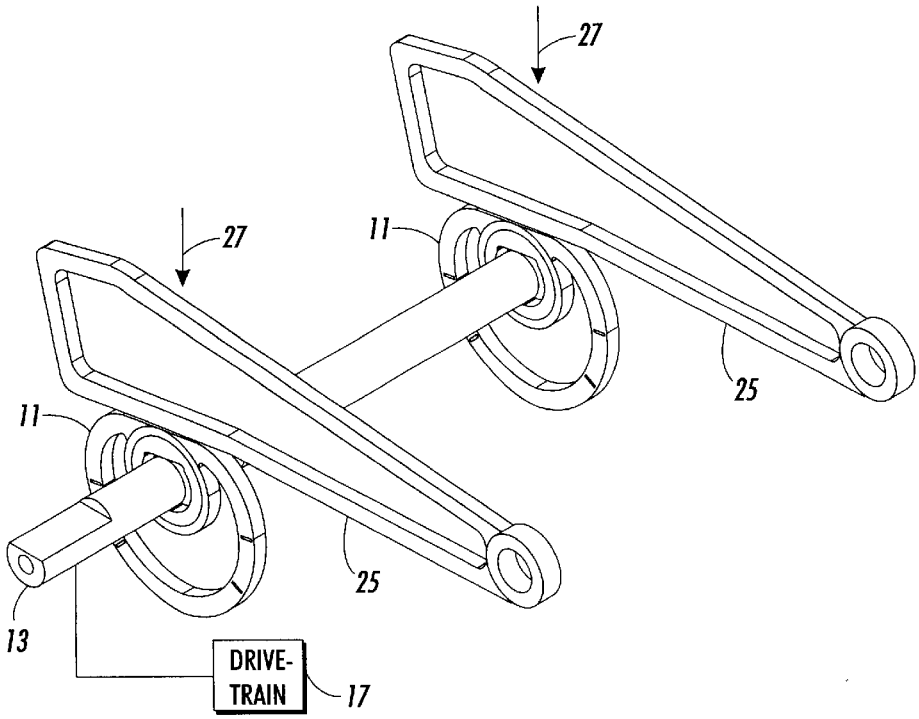
FIG. 2 is a schematic block diagram of an embodiment of another cam mechanism.

FIG. 2 is a schematic block diagram of an embodiment of a cam mechanism that includes a pair of similarly shaped cams 11 mounted on a cam shaft 13 which is driven by a drive train 17 that can include gears. Each of the cams 11 includes an active cam surface 111 (FIGS. 4, 5 and 6) that is contained within an active cam angle A (FIGS. 4, 5 and 6). A cam follower 25 is slidably engaged against the active cam surface 111, and is biased or loaded by a load force 27 to apply a cam follower force to the active cam surface 111.

Figure 3:
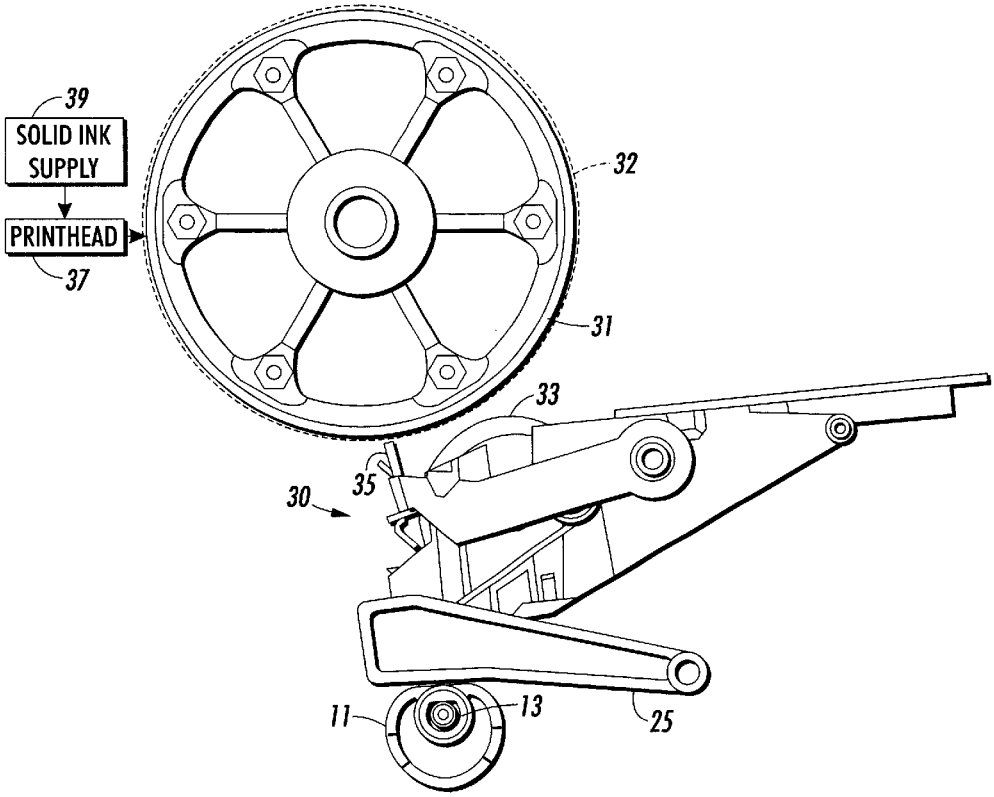
FIG. 3 is a schematic block diagram of an embodiment of a printing system that employs the cam mechanism of FIG. 2.

FIG. 3 is a schematic block diagram of an embodiment of a printing system that employs a cam mechanism substantially similar to the cam mechanism of FIG. 2 to move a drum maintenance system 30 into engagement with an imaging drum 31 of the printing system. By way of illustrative example, the drum maintenance system 30 includes a transfer surface applicator 33 and a wiper 35. The printing system can further include a printhead 37 for emitting marking drops onto a liquid transfer surface 32 such as oil that is applied to the imaging drum 31 by the transfer surface applicator 33, and a supply 39 of solid or phase-change ink. An example of a printing system that uses solid ink is disclosed in commonly assigned U.S. Pat. No. 6,113,231, incorporated herein by reference.

FIGS. 4–6 are schematic diagrams of an embodiment of the cam 11 which includes an active cam surface 111 disposed between a first terminal radius R1 and second terminal radius R2, wherein the radii R1, R2 form an active cam angle A. The active cam angle A can be less than 180 degrees, or it can be greater than or equal to 180 and less than 360 degrees, for example. Preferably, the radius R of the profile of the active cam surface 111 continually increases with angular displacement from the first terminal radius R1 such that there are no dwell regions of constant radius in the active surface 111. The active cam surface 111 thus continually decreases with angular displacement from the second terminal radius R2 toward the first terminal radius R1. The specific profile of the active cam surface 111 can be configured as appropriate to the particular functions being implemented.

For example, in the cam mechanism of FIG. 3 the cam 11 can be more particularly configured to actuate the drum maintenance system 30 of the printing system of FIG. 3. In this regard, the cam 11 can include a cam surface location C1 at the first terminal radius R1 that is selected to position the drum maintenance system 30 away from the imaging drum when the cam 11 is positioned to engage the cam follower with the cam location C1, which can be referred to as the home position or the C1 angular position (FIG. 4). The cam 11 can further include a cam surface location C2 at the second terminal radius R2 that is selected to position the drum maintenance system 30 in engagement with the imaging drum 31 when the cam 11 is angularly positioned to engage the cam follower 25 with the cam location C2, which can be called the C2 angular position of the cam (FIG. 6). Also, the cam 11 can further include a cam surface location C3 at an intermediate radius R3 that is greater than R1 and less than R2, and is selected to position the drum maintenance system 30 in partial engagement with the imaging drum 31 when the cam 11 is positioned to engage the cam follower with the cam location C3, which can be called the C3 angular position of the cam 11 (FIG. 6).

For the particular example of a drum maintenance system 30 that includes a transfer surface applicator 33 and a wiper blade 35, the transfer surface applicator 33 and the wiper blade 35 are in contact with the imaging drum 31 in the C2 cam position, while only the wiper blade 35 is in contact with the imaging drum 31 in the C3 cam position.

Thus, in use, the cam 11 is initially rotated to the home position C1 (FIG. 4) and disengaged from the drive train 17, for example by disengaging a clutch of the drive train 17. To move to the angular position C2, the clutch of the drive train 17 is engaged and the cam is driven in a clockwise (CW) direction to the angular position C2. Since the cam follower 25 is biased against the active cam surface 111 and since the radius of the active cam surface 111 increases in a counterclockwise (CCW) direction, the torque applied by the drive train 17 to the cam 11 is CW. To move to the angular position C3 from the angular position C2, the cam 11 is driven in the CCW direction to the angular position C3. Since the cam follower 25 is biased against the active cam surface 111 and since the radius of the active cam surface increases in the CCW direction, the torque applied by the drive train 17 to the cam 11 is CW since the cam follower force on the active cam surface tends to produce a counterclockwise torque. In other words, when the cam 11 is driven in the CCW direction, the drive train 17 can be considered as acting as a brake that controls the CCW rotation of the cam 11. The cam 11 can then be rotated in the CCW direction to the home position.

Thus, since the torque applied by the drive train is always in the same direction for all motions between the home position and the C2 position, the drive train 17 does not experience any torque reversals and thus no reversals in backlash. As a result, actuation of the cam 11 tends to be quieter. Generally, the cam 11 is operated only over the cam angle A and in such a manner that only the active cam surface 111 is engaged with the cam follower 25, so that the torque applied by the drive train 17 is always in one direction for all motions of the cam 11 between the C1 angular position and the C2 angular position.

By way of illustrative example, the first terminal radius R1 can be the smallest radius of the cam and a portion of the profile of the cam surface on both sides of the first terminal radius R1 can be substantially flat and generally orthogonal to the radius, such that a terminal portion of the active cam surface 111 includes a flat region. In this manner, the radius of the cam surface increases on both sides the first terminal radius R1 and the cam will tend to return to the home position C1 when it is disengaged from the drive train 17. A home position sensor may be omitted. Also, in an embodiment wherein the active cam angle A is less than 180 degrees, the profile of the cam 11 can be symmetrical about a line that passes through the first terminal radius R1, such that the cam 11 can effectively include two active cam surfaces. This allows for simpler installation since in such implementation there is no front or back of the cam 11.

The invention has been described with reference to disclosed embodiments, and it will be appreciated that variations and modifications can be affected within the spirit and scope of the invention.

What is claimed is:

1. A printing apparatus comprising:

an imaging drum;

a drum maintenance apparatus;

a cam including an active cam surface having a continually increasing radius over an active cam angle;

a biased cam follower in contact with the active cam surface for selectively moving the drum maintenance apparatus into contact with the imaging drum;

a drive mechanism for rotating the cam such that only the active cam surface contacts the cam follower; and wherein the drive mechanism includes a plurality of gears.

2. The printing apparatus of claim 1 wherein the active cam surface includes a substantially flat profile at a terminal portion of the active cam surface.

3. The printing apparatus of claim 1 wherein the cam includes a symmetrical cam profile.

4. The printing apparatus of claim 1 wherein the active cam angle is less than 180 degrees.

5. The printing apparatus of claim 1 wherein the active cam angle is greater than 180 degrees.

6. The printing apparatus of claim 1 wherein the drive mechanism rotates the cam to a plurality of predetermined angular positions.

7. The printing apparatus of claim 1 wherein the cam follower moves an imaging drum maintenance apparatus into contact with an imaging drum.

8. A printing apparatus comprising:

an imaging drum;

a drum maintenance apparatus for applying a transfer surface on the imaging drum;

a printhead for emitting drops of melted solid ink onto the transfer surface;

a cam including an active cam surface having a continually increasing radius over an active cam angle and a substantially flat profile at a terminal portion of the active cam surface;

a biased cam follower in contact with the active cam surface for selectively moving the drum maintenance apparatus into contact with the imaging drum; and a drive mechanism for rotating the cam such that only the active cam surface contacts the cam follower.

9. The printing apparatus of claim 8 wherein the cam includes a symmetrical cam profile.

10. The printing apparatus of claim 8 wherein the cam drive mechanism rotates the cam to a plurality of predetermined angular positions.

11. The printing apparatus of claim 8 wherein the cam follower moves an imaging drum maintenance apparatus into contact with an imaging drum.

12. A printing apparatus comprising:

an imaging drum;

a drum maintenance apparatus for applying a transfer surface on the imaging drum;

a printhead for emitting drops of melted solid ink onto the transfer surface;

a cam including an active cam surface having a continually increasing radius over an active cam angle that is less than 180 degrees;

a biased cam follower in contact with the active cam surface for selectively moving the drum maintenance apparatus into contact with the imaging drum; and a drive mechanism for rotating the cam such that only the active cam surface contacts the cam follower.

13. The printing apparatus of claim 12 wherein the cam includes a symmetrical cam profile.

14. The printing apparatus of claim 12 wherein the cam drive mechanism rotates the cam to a plurality of predetermined angular positions.

15. The printing apparatus of claim 12 wherein the cam follower moves an imaging drum maintenance apparatus into contact with an imaging drum.

16. A printing apparatus comprising:

an imaging drum;

a drum maintenance apparatus for applying a transfer surface on the imaging drum;

a printhead for emitting drops of melted solid ink onto the transfer surface;

a cam including an active cam surface having a continually increasing radius over an active cam angle that is greater than 180 degrees;

a biased cam follower in contact with the active cam surface for selectively moving the drum maintenance apparatus into contact with the imaging drum; and a drive mechanism for rotating the cam such that only the active cam surface contacts the cam follower.

17. The printing apparatus of claim 16 wherein the cam includes a symmetrical cam profile.

18. The printing apparatus of claim 16 wherein the cam drive mechanism rotates the cam to a plurality of predetermined angular positions.

19. The printing apparatus of claim 16 wherein the cam follower moves an imaging drum maintenance apparatus into contact with an imaging drum.

20. A printing apparatus comprising:

an imaging drum;

a drum maintenance apparatus for applying a transfer surface on the imaging drum;

a printhead for emitting drops of melted solid ink onto the transfer surface;

a cam including an active cam surface having a continually increasing radius over an active cam angle;

a biased cam follower in contact with the active cam surface for selectively moving the drum maintenance apparatus into contact with the imaging drum;

a drive mechanism for rotating the cam such that only the active cam surface contacts the cam follower; and wherein the drive mechanism includes a plurality of gears.

21. The printing apparatus of claim 20 wherein the cam includes a symmetrical cam profile.

22. The printing apparatus of claim 20 wherein the cam drive mechanism rotates the cam to a plurality of predetermined angular positions.

23. The printing apparatus of claim 20 wherein the cam follower moves an imaging drum maintenance apparatus into contact with an imaging drum.

24. A drive system for a printer comprising:

a cam including an active cam surface having a continually increasing radius over an active cam angle;

a biased cam follower in contact with the active cam surface; and a drive mechanism for rotating the cam such that only the active cam surface contacts the cam follower; and wherein the drive mechanism includes a plurality of gears.

25. The drive system of claim 24 wherein the active cam surface includes a substantially flat profile at a terminal portion of the active cam surface.

26. The drive system of claim 24 wherein the cam includes a symmetrical cam profile.

27. The drive system of claim 24 wherein the active cam angle is less than 180 degrees.

28. The drive system of claim 24 wherein the active cam angle is greater than 180 degrees.

29. The drive system of claim 24 wherein the drive mechanism rotates the cam to a plurality of predetermined angular positions.

30. The drive system of claim 24 wherein the cam follower moves an imaging drum maintenance apparatus into contact with an imaging drum.

* * * * *